US007257972B2

(12) United States Patent
Bright

(10) Patent No.: US 7,257,972 B2
(45) Date of Patent: Aug. 21, 2007

(54) LOCKING CASE FOR A TOOTHBRUSH

(76) Inventor: Aaron L. Bright, 1551 Jackson Ave., Memphis, TN (US) 38107-4460

( * ) Notice: Subject to any disclaimer, the term of this patent is extended or adjusted under 35 U.S.C. 154(b) by 0 days.

(21) Appl. No.: 11/190,659

(22) Filed: Jul. 26, 2005

(65) Prior Publication Data

US 2006/0037370 A1 Feb. 23, 2006

Related U.S. Application Data

(63) Continuation-in-part of application No. 10/923,465, filed on Aug. 20, 2004, now abandoned.

(51) Int. Cl.
*E05B 69/00* (2006.01)

(52) U.S. Cl. ..... 70/58; 70/14; 70/63; 70/23; 206/1.5; 206/362.1; 132/308

(58) Field of Classification Search ..... 70/58, 70/63, 14, 18, 19, 233, 21–23, 32–34; 109/45, 109/50–54; 132/308, 310–312; 206/1.5, 206/209, 361–362.4, 15.2, 15.3
See application file for complete search history.

(56) References Cited

U.S. PATENT DOCUMENTS

| | | | | | |
|---|---|---|---|---|---|
| 1,222,920 | A | | 4/1917 | Blais | |
| 1,267,894 | A | | 5/1918 | Olson | |
| 1,472,206 | A | | 10/1923 | Burkle | |
| 1,627,462 | A | | 5/1927 | Rohmer | |
| 1,633,834 | A | * | 6/1927 | Vaitulis | 206/362.1 |
| 1,914,276 | A | | 6/1933 | Moore | |
| 2,275,549 | A | | 3/1942 | Oshman et al. | |
| 2,317,111 | A | * | 4/1943 | Perwas | 15/184 |
| 2,459,285 | A | * | 1/1949 | Murphy | 401/124 |
| 2,476,686 | A | * | 7/1949 | Smith et al. | 401/191 |
| 2,509,339 | A | * | 5/1950 | Fair | 401/117 |
| 2,556,584 | A | * | 6/1951 | Hofmann | 132/308 |
| 2,725,270 | A | | 11/1955 | Upchurch | |
| 2,775,250 | A | * | 12/1956 | Oxenrider | 132/308 |
| 2,883,692 | A | * | 4/1959 | Philip et al. | 15/184 |
| 3,574,879 | A | | 4/1971 | Werding | |
| 3,769,991 | A | * | 11/1973 | McGrath | 132/308 |
| 3,867,823 | A | | 2/1975 | Waltower | |
| 3,894,550 | A | | 7/1975 | Eaton | |
| 3,906,758 | A | | 9/1975 | Hurwitt | |
| 3,934,434 | A | * | 1/1976 | Law | 70/63 |
| 3,988,823 | A | * | 11/1976 | Hu | 438/624 |
| 3,988,909 | A | * | 11/1976 | Catapano | 70/63 |

(Continued)

*Primary Examiner*—Suzanne Dino Barrett
(74) *Attorney, Agent, or Firm*—Walker, McKenzie & Walker, P.C.

(57) ABSTRACT

A locking storage case for holding a toothbrush. As two parts of the case are slidably engaged with each other to form an enclosed cavity holding the toothbrush, a combination lock, integrally and rigidly mounted to the parts of the case, becomes engaged for locking the case. A suction cup is provided for hanging the locking case from a smooth surface. A resealable plastic bag is provided within the locking case for sealing the toothbrush from germs and moisture and contaminants, and the resealable bag may have an antibacterial coating on its interior surface. A toothpaste tube may be provided in the cavity, and the toothbrush may have a removable head attached to a body that is joined to one of the case parts.

12 Claims, 2 Drawing Sheets

U.S. PATENT DOCUMENTS

| | | | | |
|---|---|---|---|---|
| RE29,208 | E | 5/1977 | Naito | |
| 4,064,715 | A | 12/1977 | Hodgson et al. | |
| 4,213,314 | A * | 7/1980 | Trader | 70/68 |
| 4,398,403 | A | 8/1983 | Melnick | |
| 4,543,806 | A | 10/1985 | Papandrea et al. | |
| 4,597,273 | A | 7/1986 | Reichenberger | |
| 4,755,248 | A | 7/1988 | Geiger et al. | |
| 4,805,426 | A | 2/1989 | Dimmick et al. | |
| 4,884,688 | A | 12/1989 | Hurst | |
| 5,095,924 | A * | 3/1992 | Stanfield | 132/315 |
| 5,368,406 | A * | 11/1994 | Hanshaw | 401/195 |
| 5,423,427 | A * | 6/1995 | Brown | 206/581 |
| 5,566,828 | A | 10/1996 | Claes et al. | |
| 5,862,817 | A * | 1/1999 | Lee | 132/311 |
| 6,253,773 | B1 * | 7/2001 | Ingemann | 132/310 |
| 6,526,991 | B2 * | 3/2003 | Bodwalk | 132/309 |
| D479,787 | S | 9/2003 | Degen | |
| 6,851,285 | B1 * | 2/2005 | Haas | 70/26 |
| 6,895,976 | B2 * | 5/2005 | Hetzler et al. | 132/308 |
| 7,080,530 | B2 * | 7/2006 | Haas | 70/26 |

* cited by examiner 54
46'
72
68
58
74
62
50
60
56
26
3
48
46'
54
76
56
72
46
52
38
43
28
44
42
32
40
34
24
78
80
22
20
36
30
28
48
46
72
60
68
56
62
58
74
64
50
76
66
70
52

LOCKING CASE FOR A TOOTHBRUSH

CROSS REFERENCE TO RELATED APPLICATIONS

This application is a continuation-in-part of U.S. patent application Ser. No. 10/923,465, filed Aug. 20, 2004 now abandoned.

STATEMENT REGARDING FEDERALLY SPONSORED RESEARCH OR DEVELOPMENT

Not applicable.

REFERENCE TO COMPACT DISC(S)

Not applicable.

BACKGROUND OF THE INVENTION

1. Field of the Invention

The present invention relates, in general, to storage cases for use in the bathroom and locker rooms, and in particular, to storage cases for toothbrushes.

2. Description of Related Art

Shared bathroom situations and locker rooms often provide a challenge to sanitary dental hygiene. Angry or prankster co-workers or roommates might accidentally or intentionally drop one's toothbrush in the toilet or on the floor or use it to clean crevices, causing germs and debris to be present on the toothbrush that will then be placed in the toothbrush owner's mouth during daily brushing. A safe and convenient means of storage is therefore needed that will not inconvenience the toothbrush owner yet will still prevent germs and debris from being placed on the toothbrush by others. Well-known solutions for this problem include locked cabinets and the like, but individually-locked cabinets may not be practical in group living situations or in the armed forces or in firehouses and the like, and locked cabinets also present the problem of safe storage of keys while showering.

It is therefore desirable to have a storage case for a toothbrush that can be secured from access by others and that provides convenient and sanitary storage of the toothbrush in group living and group bathroom situations when the toothbrush is not in use. It is further desirable to have a storage case for holding a toothbrush together with a tube of toothpaste for use therewith.

A preliminary patentability search in Class 70, Subclasses 63, 61, 231, 232, Digest 34 and Digest 63; Class 312, Subclasses 206, 207; Class 206, Subclasses 361 and 362.2; Design Class 4, Subclass 108; and text searching on the Patent and Trademark Office EAST database system produced the following patents, some of which may be relevant to the present invention:

Moore, U.S. Pat. No. 1,914,276 (issued Jun. 13, 1933), simply shows a tool rack for locking tools therein. This patent does not show a locking case for housing a toothbrush, and does not suggest that this rack could be used with a toothbrush.

Oshman et al., U.S. Pat. No. 2,275,549 (issued Mar. 10, 1942), shows different embodiments of a spring-loaded tooth brush retainer that entraps the head of the toothbrush for hanging the toothbrush on a wall, but there is no suggestion or disclosure of a locking mechanism.

Upchurch, U.S. Pat. No. 2,725,270 (issued Nov. 29, 1955), shows a toothbrush container that serves as a sales package and also a wall holder for the toothbrush, but there is no suggestion or disclosure of a locking mechanism.

Werding, U.S. Pat. No. 3,574,879 (issued Apr. 13, 1971), shows a toothbrush holder for a toothbrush, in which the toothbrush's handle telescopes as the toothbrush is removed from the holder, but there is no suggestion or disclosure of a locking mechanism.

Waltower, U.S. Pat. No. 3,867,823 (issued Feb. 25, 1975), shows a locking key case, but does not show a locking case for housing a toothbrush, and does not suggest that this case could be used with a toothbrush.

Eaton, U.S. Pat. No. 3,894,550 (issued Jul. 15, 1975), shows a cabinet with a time clock for holding dental supplies. A toothbrush is one of the supplies that can be held and, at column 2, lines 28-30, it is disclosed that the door may be provided with a lock.

Hurst, U.S. Pat. No. 4,884,688 (issued Dec. 5, 1989), shows a toothbrush case for holding a toothbrush. The top and bottom of the case are threadedly screwed together, and the head of the toothbrush is retained within a reservoir having a plug (30) that can be unscrewed from the reservoir to fill the case with a sanitizing liquid (see FIG. 5). However, there is no suggestion or disclosure of a locking mechanism for the case.

Claes et al., U.S. Pat. No. 5,566,828 (issued Oct. 22, 1996), shows a locking package for a syringe, and there is no suggestion of storing a toothbrush inside this case.

In addition to these patents found in the preliminary patentability search, other patents are known as prior art.

Dimmick et al., U.S. Pat. No. 4,805,426 (issued Feb. 21, 1989), discloses a barrel-type combination lock that receives a lock element extending from a safety pin housing. Other patents are also known that disclose combination cable locks, and representative patents include U.S. Pat. Nos. 3,611,760; 1,222,920; 1,267,894; 1,472,206; 1,627,462; 3,906,758; Hodgson, et al., U.S. Pat. No. 4,064,715 (issued Dec. 27, 1977); Melnick, U.S. Pat. No. 4,398,403 (issued Aug. 16, 1983); Papandrea, et al., U.S. Pat. No. 4,543,806 (issued Oct. 1, 1985); and Reichenberger, U.S. Pat. No. 4,597,273 (issued Jul. 1, 1986).

Naito, U.S. Reissue Pat. No. 29,208 (issued May 10, 1977), and Geiger, et al., U.S. Pat. No. 4,755,248 (issued Jul. 5, 1988), disclose methods and apparatus for manufacturing resealable plastic bags as might be used with the present invention.

Degen, U.S. Design Pat. D479,787 (issued Sep. 23, 2003) discloses a clamp having a suction cup such as might be used with the present invention.

None of these references, either singly or in combination, disclose or suggest the present invention.

BRIEF SUMMARY OF THE INVENTION

The present invention is a locking storage case for a toothbrush. As two parts of the case are slidably engaged with each other, a combination lock that is integrally and rigidly mounted to the parts of the case becomes engaged for locking the case. A suction cup is preferably-provided for hanging the locking case from a surface such as a mirror or wall. A resealable plastic bag is preferably provided within the locking case for sealing the toothbrush from germs and moisture and contaminants, and the resealable bag preferably has an antibacterial coating on its interior surface.

A second embodiment of the present invention is likewise a locking storage case for a toothbrush and additionally holds a tube of toothpaste for use with the toothbrush. The head of the toothbrush is removably attached to one of the parts of the case, and can be easily detached and replaced when the bristles become worn or used.

It is an object of the present invention to provide a storage case for a toothbrush that can be secured from opening by others and that provides convenient and sanitary storage of the toothbrush in group living and group bathroom situations when the toothbrush is not in use. It is a further object of the present invention to provide secure storage for a tube of toothpaste within the storage case.

DETAILED DESCRIPTION OF THE INVENTION

Figures 1, 2, 3:
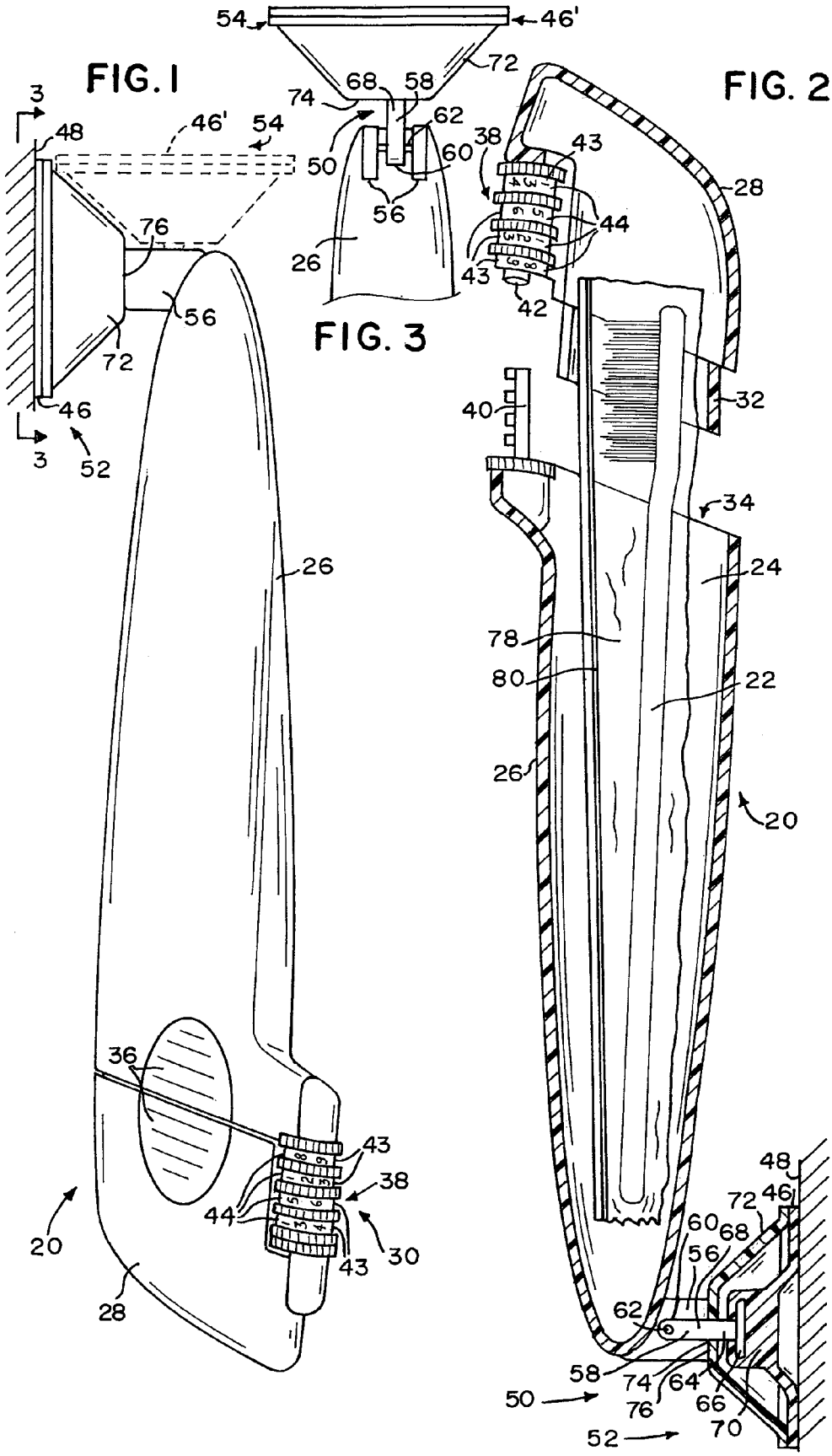
FIG. 1 is a side view of the first embodiment of the present invention in the closed condition and hanging from vertical surface, and showing the pivoting of the suction cup between the first and second positions. The view from the reverse side is substantially a mirror image of FIG. 1.
FIG. 2 is a side sectional view of the first embodiment of the present invention in the opened condition and showing a toothbrush inside. A side sectional view taken in the reverse direction is substantially a mirror image of FIG. 2.
FIG. 3 is a view of the end of both embodiments of the present invention with the suction cup in the second (released) position, taken substantially along the line 3-3 shown in FIG. 1.

Referring to FIGS. 1-3, a first embodiment of the present invention is the combination of a locking case 20 for holding a toothbrush 22, together with toothbrush 22 being received within an enclosed compartment 24 of the locking case 20. Locking case 20 comprises a first case part 26 and a second case part 28 and a combination lock 30 integrally mounted to first and second case parts 26, 28, which are made of metal or preferably a hard and durable plastic. Locking case 20 may be provided in a variety of colors and themes to allow easy and sure identification of each user's toothbrush, and a name tag (not shown) may also be provided. Preferably, first and second case parts 26, 28 are respectively provided with grooved thumb and finger grips 36 to make it easy to slidably separate first and second case parts 26, 28 and to slidably engage first and second case parts 26, 28 as will now be described in detail.

First case part 26 is preferably larger than second case part 28, with second case part 28 preferably being a top or cap that is slidably received on and into first case part 26, which is the body of the locking case, as by having reduced-diameter flange 32 of second case part 28 being slidably received into the mouth 34 of first case part 26. First and second case parts 26, 28, thus being adapted for slidable mutual engagement, form an enclosed compartment 24 within locking case 20 when first and second case parts 26, 28 are mutually engaged with second case part 28 being slidably received on and into first case part 26.

Lock 30 is preferably similar in structure to a well-known barrel-type combination cable lock in which separate portions of the lock are attached to ends of a cable that is wound around and/or through an item to be secured. However, it should be understood that a well-known pushbutton combination lock, or other types of combination locks, could be adapted and equivalently used with the present invention. Exemplary patents describing cable locks are U.S. Pat. Nos. 4,805,426; 3,611,760; 1,222,920; 1,267,894; 1,472,206; 1,627,462; 3,906,758; 4,064,715; 4,398,403; 4,543,806; and 4,597,273, all of which are incorporated fully herein by reference. Because those skilled in the art understand the structure and operation of such combination cable locks, the detailed structure of such locks need not be repeated here.

Lock 30 is integrally and fixedly mounted to first and second case parts 26, 28 by having a lock housing 38 integrally and fixedly mounted to one of the first and second case parts 26, 28, and by having a lock finger 40 integrally and fixedly mounted to the other of the first and second case parts 26, 28. The drawings show the preferred embodiment in which lock housing 38 is integrally and fixedly mounted to second case part 28 and in which lock finger 40 is integrally and fixedly mounted to first case part 26, but it shall be understood that it would be an equivalent and trivial variation of the preferred embodiment to have lock housing 38 be integrally and fixedly mounted to first case part 26 and to have lock finger 40 be integrally and fixedly mounted to second case part 28. Lock housing 38 has a recess 42 therein passing axially through the plurality of combination elements 43 such as combination barrels 44, and recess 42 is adapted for sliding receipt of lock finger 40. A structural feature of locking case 20 is that, as second case part 28 becomes slidably engaged with first case part 26, lock finger 40 simultaneously becomes slidably received within recess 42 of lock housing 38. Once lock finger 40 is fully slidably received within recess 42, combination elements 43 such as barrels 44 may then be moved to random positions such that the lock cannot be reopened unless the correct combination is set on combination elements 43 of lock 30, thereby causing combination elements 43 to retain lock finger 40 within lock housing 38 by locking engagement of combination elements 43 with lock finger 40 in a manner that is now understood by those skilled in the art. It will also now be understood that, when combination elements 43 are in locking engagement with lock finger 40, first and second case parts 26, 28 cannot be separated for access to toothbrush 22, thereby only permitting access to toothbrush 22 by those persons who know the correct combination for lock 30.

Preferably locking case 20 further includes a suction cup 46 attached thereto for adhering to a smooth surface 48 such as a bathroom wall, a cabinet surface, a ceramic tile wall, a shower door; or a sink, etc., thereby providing convenient storage of the locking case 20 with toothbrush 22 thereinside when toothbrush 22 is not being used. While suction cup 46 may be attached to locking case 20 as by a string or wire or chain, preferably suction cup 46 is pivotally attached to locking case 20 as shown and with locking case 20 further comprising suction actuation means 50 for creating a suction between suction cup 46 and surface 48 when suction cup 46 is pivoted into a first position 52 (shown in solid outline in FIGS. 1 and 2) with respect to locking case 20 and for releasing the suction between suction cup 46 and surface 48 when suction cup 46 is pivoted into a second or released position 54 (shown by changed-position suction cup 46' in dotted outline in FIG. 1 and in solid outline in FIG. 3) with respect to locking case 20. Suction cup 46 is substantially cylindrically symmetric and is preferably made of a soft and pliable rubber or plastic that can easily suctionally attach to surface 48.

Degen, U.S. Design Pat. D479,787 (issued Sep. 23, 2003), fully incorporated herein by reference, discloses a clamp having a suction cup such as might be used with the present invention.

Suction actuation means 50 comprises a pair of legs 56 mounted to and extending outwardly from first case part 26, with a rigid member 58 having its proximal end 60 being mounted on an pin 62 between legs 56 for pivotal movement about the axis of pin 62. The distal end 64 of member 58 has a circular disk 66 perpendicular to the shaft 68 of member 58, and disk 66 is entrapped within a mounting 70 on the rear of suction cup 46. Suction cup 46 is preferably mounted within a rigid cap 72 that is substantially cylindrically symmetric, and shaft 68 of member 58 slidably passes through an opening 74 in the center of cap 72. As member 58 reciprocates with respect to cap 72, disk 66 pulls at its mounting 70 on the rear of suction cup 46, thereby causing the center of suction cup 46 to be pulled away from surface 48 so as to create a suction or vacuum between suction cup 46 and surface 48. When suction cup 46 and cap 72 are pivoted into the second or released position 54 shown in FIG. 3, legs 56 do not engage with the top 76 of cap 72, thereby allowing member 58 to reciprocate relative to cap 72 so as to permit the center of suction cup 46 to become relaxed and to release the suction with surface 48. When suction cup 46 and cap 72 are pivoted into the first position 52 shown in solid outline in FIGS. 1 and 2, legs 56 engage the top 76 of cap 72 so as to pull member 58, and its mounting 70, away from the surface 48, thereby causing the center of suction cup 46 to be pulled perpendicular to surface 48, thereby creating a suction with surface 48.

If desired, a gasket or seal (not shown) may be situated at the interface between first and second case parts 26, 28 so as to seal first and second case parts 26, 28 together and prevent germs or germ-filled moisture from entering compartment 24 when locking case 20 is locked together. Alternatively and preferably, a well-known resealable plastic bag 78 is included for sealing toothbrush 22 therewithin, with resealable bag 78 holding toothbrush 22 sealed therewithin being placed within compartment 24 prior to locking the locking case 20. Resealable bag 78 is sized to receive toothbrush 22 and its bristles therewithin, and prevents contaminated moisture and liquids from contacting toothbrush 22 as might otherwise happen if, for example, locking case 20 were to fall or be dropped into a toilet. If desired and preferably, resealable bag 78 may be coated on its interior with a well-known antibacterial coating to kill germs that might otherwise contaminate toothbrush 22. Resealable bag 78 is well-known and is sold, for example, under the trademark ZIPLOC by Dow Chemical Company and its affiliate Dow Brands L.P., P.O. Box 68511, Indianapolis, Ind., U.S.A. Resealable bag 78 has a plurality of interlocking rib and groove profiles 80 that allow the mouth of the bag 78 to be sealed, then unsealed to permit access to the interior of bag 78, and then resealed as desired. Naito, U.S. Reissue Pat. No. 29,208 (issued May 10, 1977), fully incorporated by reference herein, and Geiger, et al., U.S. Pat. No. 4,755,248 (issued Jul. 5, 1988), also fully incorporated by reference herein, disclose methods and apparatus for manufacturing such resealable plastic bags as might be used with the present invention.

To use the first embodiment of the present invention, a person uses toothbrush 22 and then, after use, places the toothbrush within bag 78 and seals bag 78. The sealed bag 78, with toothbrush 22 inside, is placed within cavity 24 of first case part 26 and second case part 28 is slidably received onto and into first case part 26, with lock finger 40 being simultaneously slidably received into recess 42, and combination elements 43 are then moved to random positions so as to cause lock 30 to become locked. Suction cup 46 is pivoted into second (released) position 54 shown in FIG. 3 and then pressed against surface 48, and locking case 20 is then permitted to gently drop into the downwardly-depending position shown in FIG. 1 (thereby causing suction cup 46 to enter the first position 52) in which locking case 20 hangs by suction cup 46 from surface 48 while toothbrush 22 is not in use. To again use toothbrush 22, locking case 20 is raised until suction cup 46 is pivoted into the second (released) position 54 shown in FIG. 3, thereby releasing the suction with surface 48. Combination elements 43 are turned to the correct combination, and locking case 20 is then opened. Toothbrush 22 is then removed from resealable bag 78, and can be used for dental hygiene.

Figure 4:
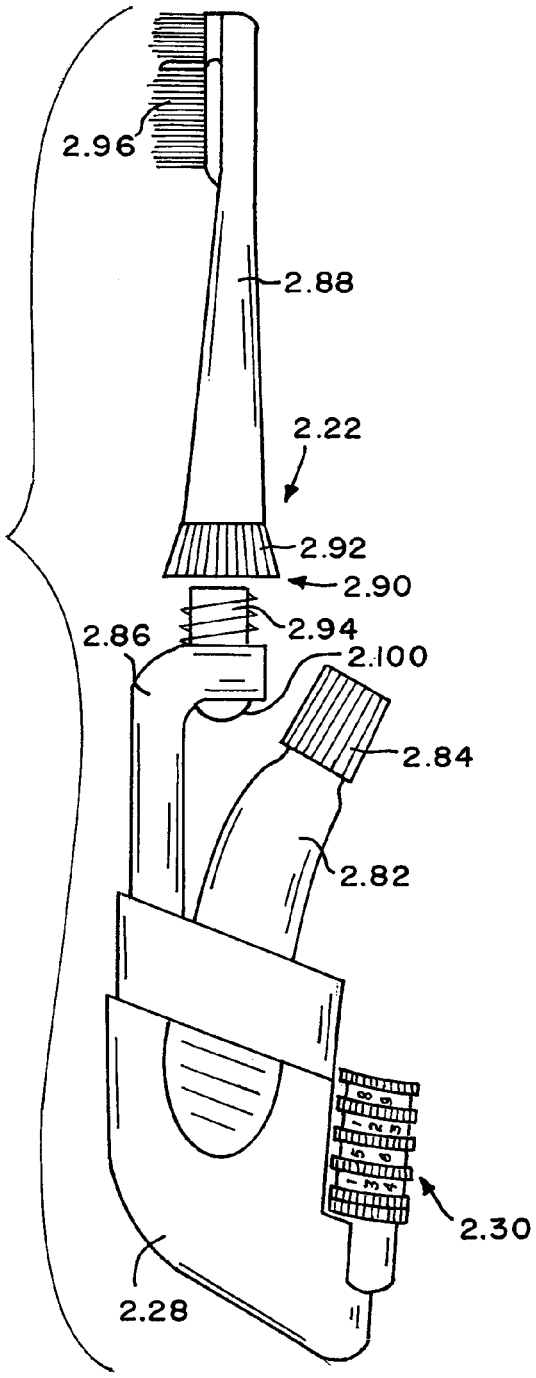
FIG. 4 is a side view of the first case part of the second embodiment of the present invention, showing removal of the toothbrush and insertion of the tube of toothpaste.
Figure 5:
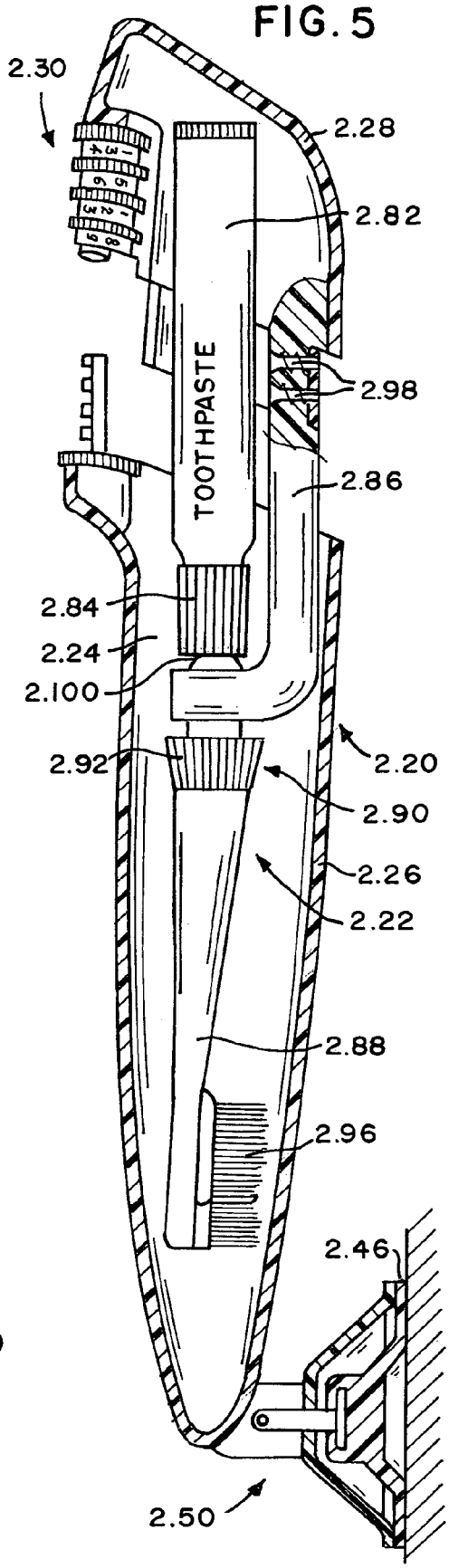
FIG. 5 is a side sectional view of the second embodiment of the present invention in the opened condition and showing a toothbrush and a tube of toothpaste inside. A side sectional view taken in the reverse direction is substantially a mirror image of FIG. 5.

A second embodiment of the present invention is shown in FIGS. 4 and 5. Identifying reference designators for this second embodiment are marked similarly to the first embodiment, except with the prefix "2.". It shall be understood that many aspects of the two embodiments are substantially the same, and only the differences will be treated in detail, it being understood that similar structural features of the two embodiments perform similar functions. Specifically, first case part 2.26 of the locking case 2.20 of the second embodiment is substantially identical to first case part 26 of the locking case 20 of the first embodiment heretofore described, with the same suction cup 2.46 and suction actuation means 2.50 as the corresponding respective structure, 46 and 50, of the first embodiment, and the lock 2.30, which securely locks the two parts of case 2.20, is substantially identical to lock 30 of the first embodiment heretofore described. As with the first embodiment, a gasket or seal (not shown) may be situated at the interface between first and second case parts 2.26, 2.28 so as to seal first and second case parts 2.26, 2.28 together and prevent germs or germ-filled moisture from entering compartment 2.24 when locking case 2.20 is locked together.

Locking case 2.20 of the second embodiment has a well-known small tube of toothpaste 2.82 that is received into compartment 2.24 and held therewithin when the first and second case parts 2.26, 2.28 are locked together. Toothpaste tube 2.82 may be, for example, a promotional or courtesy tube of toothpaste as is found in hotels and motels for guests, etc., and has a well-known screw cap 2.84 holding the toothpaste within the tube 2.82. During insertion into and removal from compartment 2.24, the flexible toothpaste tube 2.82 may be bent slightly if necessary as shown in FIG. 4 in order to facilitate removal from and insertion into compartment 2.24. Because toothpaste tube 2.82 is enclosed within compartment 2.24 when case parts 2.26, 2.28 are locked together, tampering with toothpaste tube 2.82 is prevented unless the case parts are unlocked for use of the toothbrush and toothpaste by the intended user who knows the combination to the lock.

The toothbrush 2.22 of the second embodiment comprises a toothbrush body 2.86 and a toothbrush head 2.88 that are removably attached to each other at a well-known screw fitting 2.90. Screw fitting 2.90 may have a fluted or grooved circumferential grip portion 2.92 to facilitate gripping while attaching and removing the head 2.88 to and from body 2.86, and body 2.86 preferably has an axially-extending threaded post 2.94 that engages with a well-known internally-threaded bore (not shown) in head 2.88 to secure head 2.88 to body 2.86 in a manner that will now be apparent. Toothbrush head 2.88 is similar to well-known disposable toothbrush heads used on powered home toothbrush appliances, and has a plurality of well-known bristles 2.96 extending from head 2.88. Toothbrush head 2.88 can thus be easily removed and replaced as desired with another disposable head 2.88 whenever the bristles 2.96 of head 2.88 become worn or dirty.

For the second embodiment, toothbrush 2.22, and specifically, preferably toothbrush body 2.86, is preferably fixedly joined to one of first and second case parts 2.26, 2.28 such as, for example, being joined by rivets or screws 2.98 to second case part 2.28 as shown in FIG. 5 or, equivalently, by being glued to second case part 2.28 or by having the plastic of body 2.86 being melted to the plastic of second case part 2.28 or by having second case part 2.28 and body 2.86 being molded as an integral unit. Preferably a hemispherical nib 2.100 is provided that extends from toothbrush 2.22, as from toothbrush body 2.86, and engages an axially-disposed concave recess (not shown) in the cap of toothpaste tube 2.82 so as to securely retain toothpaste tube 2.82 within compartment 2.24.

To use the second embodiment of the present invention, a person opens the lock 2.30 as heretofore described, separates the first and second case parts 2.26, 2.28, removes the tube of toothpaste 2.82 as shown in FIG. 4, applies toothpaste to bristles 2.96 in the well-known manner, and practices proper dental hygiene by gripping second case part 2.28, which becomes the handle for toothbrush 2.22 because of the fixed joining of toothbrush body 2.86 to second case part 2.28. After the person's teeth have been properly brushed, the toothbrush bristles 2.96 can be washed, the toothpaste tube 2.82 can be reinserted into the compartment 2.24 as shown in FIG. 4, and the first and second case parts 2.26, 2.28 can then be locked together by lock 2.30 as heretofore explained for the first embodiment.

It should be noted that an advantage of the second embodiment of the present invention allow the user to grip the second part 2.28 to use the toothbrush, and second part 2.28 becomes the handle for the toothbrush. An advantage of this structure is that, while using the toothbrush, the user's hand covers the combination of lock 2.30, thereby preventing the prying eyes of others from seeing the combination, and also permitting first part 2.26 to remain suctionally hanging from the mirror or wall surface, unattended, without exposing the combination for viewing by others.

Although the present invention has been described and illustrated with respect to a preferred embodiment and a preferred use therefor, it is not to be so limited since modifications and changes can be made therein which are within the full intended scope of the invention.

I claim:

1. In combination:

(a) a locking case for holding a toothbrush, said locking case comprising:

i. a first case part and a second case part adapted for slidable telescoping mutual engagement forming an enclosed compartment therewithin when mutually engaged, said first and second case parts jointly having a longitudinal longest dimension when so said mutually engaged and said slidable telescoping mutual engagement being along said longitudinal longest dimension; and ii. a combination lock integrally mounted to said first and second case parts, said lock having a lock housing mounted to one of said first and second case parts and having a lock finger fixedly mounted to the other of said first and second case parts; said lock finger extending from said other of said first and second case parts substantially parallel to said longitudinal dimension; said lock housing having a recess therein adapted for sliding receipt of said lock finger; said lock housing including a plurality of combination elements mounted for rotation about a common axis for locking engagement with said lock finger when said lock finger is slidably received within said lock housing along said axis; and (b) a toothbrush received within said enclosed compartment of said locking case.

2. The combination as recited in claim 1, in which said locking case further comprises a suction cup attached thereto for adhering to a surface.

3. The combination as recited in claim 2, in which said suction cup is pivotally attached to said locking case and said locking case further comprises suction actuation means for creating a suction between said suction cup and said surface when said suction cup is pivoted into a first position with respect to said locking case and for releasing said suction between said suction cup and said surface when said suction cup is pivoted into a second position with respect to said locking case.

4. The combination as recited in claim 1, additionally comprising a resealable bag within said enclosed compartment, said toothbrush being sealed within said resealable bag.

5. The combination as recited in claim 4, in which said locking case further comprises a suction cup attached thereto for adhering to a surface.

6. The combination as recited in claim 5, in which said suction cup is pivotally attached to said locking case and said locking case further comprises suction actuation means for creating a suction between said suction cup and said surface when said suction cup is pivoted into a first position with respect to said locking case and for releasing said suction between said suction cup and said surface when said suction cup is pivoted into a second position with respect to said locking case.

7. The combination as recited in claim 1, in which said toothbrush is joined to one of said first and second case parts, said head having a plurality of bristles extending therefrom.

8. The combination as recited in claim 7 further comprising a tube of toothpaste received within said enclosed compartment.

9. The combination as recited in claim 1, in which said toothbrush comprises a body and a head removably attached to each other, said body being joined to one of said first and second case parts, said head having a plurality of bristles extending therefrom.

10. The combination as recited in claim 9, in which said body and said head of said toothbrush are said removably attached to each other at a screw fitting.

11. The combination as recited in claim 10 further comprising a tube of toothpaste received within said enclosed compartment.

12. The combination as recited in claim 1 further comprising a tube of toothpaste received within said enclosed compartment.

* * * * *